US011348525B2

(12) United States Patent
Chen et al.

(10) Patent No.: US 11,348,525 B2
(45) Date of Patent: May 31, 2022

(54) PIXEL CIRCUIT, DISPLAY PANEL, DISPLAY DEVICE AND CONTROL METHOD FOR PIXEL CIRCUIT

(71) Applicant: BOE TECHNOLOGY GROUP CO., LTD., Beijing (CN)

(72) Inventors: Liang Chen, Beijing (CN); Lei Wang, Beijing (CN); Li Xiao, Beijing (CN); Dongni Liu, Beijing (CN); Xiaochuan Chen, Beijing (CN); Minghua Xuan, Beijing (CN); Ning Cong, Beijing (CN); Detao Zhao, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 332 days.

(21) Appl. No.: 16/479,694

(22) PCT Filed: Jan. 2, 2019

(86) PCT No.: PCT/CN2019/070028

§ 371 (c)(1),
(2) Date: Jul. 22, 2019

(87) PCT Pub. No.: WO2019/223329

PCT Pub. Date: Nov. 28, 2019

(65) Prior Publication Data

US 2021/0350747 A1 Nov. 11, 2021

(30) Foreign Application Priority Data

May 22, 2018 (CN) ..... 201810496173.5

(51) Int. Cl.

| | |
|---|---|
| ***G09G 3/3266*** | (2016.01) |
| ***G09G 3/3275*** | (2016.01) |
| ***G09G 3/3258*** | (2016.01) |

(52) U.S. Cl.
CPC ..... *G09G 3/3258* (2013.01); *G09G 3/3266* (2013.01); *G09G 3/3275* (2013.01); *G09G 2360/14* (2013.01)

(58) Field of Classification Search
CPC .... G06F 3/042; G09G 3/3208; G09G 3/3225; G09G 3/3233; G09G 3/3258;
(Continued)

(56) References Cited

U.S. PATENT DOCUMENTS 5,504,323 A 4/1996 Heeger et al.
9,207,851 B1 * 12/2015 Han ..... G06F 3/0488
(Continued)

FOREIGN PATENT DOCUMENTS

CN 1605094 A 4/2005
CN 101084537 A 12/2007
(Continued)

OTHER PUBLICATIONS

First Office Action for Chinese Patent Application No. 201810496173.5 dated Oct. 24, 2019.

*Primary Examiner* — Michael J Eurice
(74) *Attorney, Agent, or Firm* — Calfee, Halter & Griswold LLP

(57) ABSTRACT

A pixel circuit, a display panel, and a display device comprising the pixel circuit. The pixel circuit comprises a light emitting element and a driving circuit. The driving circuit comprises a light emission driving circuit for driving the light emitting element to emit light, and a light sensing driving circuit for controlling the light emitting element to convert external light incident on the light emitting element into an electrical signal. The pixel circuit integrates the light emission driving circuit with the light sensing driving circuit and can achieve the light sensing function for the screen of the display device, which makes it possible to not reserve an
(Continued)

area dedicated to a camera on the surface of the display device.

14 Claims, 2 Drawing Sheets

(58) Field of Classification Search
CPC ..... G09G 3/3266; G09G 3/3275; G09G 2300/0809; G09G 2300/0842; G09G 2360/14; G09G 2360/148
See application file for complete search history.

(56) References Cited

U.S. PATENT DOCUMENTS

| | | | | |
|---|---|---|---|---|
| 2005/0061953 | A1 | 3/2005 | Huiberts et al. | |
| 2007/0252005 | A1* | 11/2007 | Konicek ..... | G06K 9/00899 235/435 |
| 2009/0316381 | A1 | 12/2009 | Kurt | |
| 2014/0300281 | A1* | 10/2014 | Chaji ..... | G09G 3/3266 315/161 |
| 2018/0373915 | A1 | 12/2018 | Ling et al. | |

FOREIGN PATENT DOCUMENTS

| | | | |
|---|---|---|---|
| CN | 101110469 | A | 1/2008 |
| CN | 106229331 | A | 12/2016 |
| CN | 108766341 | A | 11/2018 |
| WO | 9516275 | A1 | 6/1995 |

* cited by examiner

PIXEL CIRCUIT, DISPLAY PANEL, DISPLAY DEVICE AND CONTROL METHOD FOR PIXEL CIRCUIT

RELATED APPLICATION

The present application is a 35 U.S.C. 371 U.S. national stage entry of PCT International Application No. PCT/CN2019/070028, filed on Jan. 2, 2019, which claims the benefit of Chinese Patent Application No. 201810496173.5, filed on May 22, 2018, the entire contents of which are incorporated herein by reference.

TECHNICAL FIELD

The present disclosure relates to the field of display technologies, and particularly to a pixel circuit, a display panel and a display device comprising the pixel circuit, and a control method for such a pixel circuit.

BACKGROUND

At present, mobile electronic devices such as mobile phones have been widely used in people's daily work and life, and have become a necessity for people to carry around. Moreover, in order to satisfy people's sociality and entertainment, a mobile electronic device typically has a photographing function. Specifically, the mobile electronic device comprises a camera, and an area dedicated to the camera is reserved on the front surface or back surface of the mobile electronic device. Moreover, the camera needs to be exposed so as to be able to acquire image information of an external object through a photosensitive element of the camera.

SUMMARY

Exemplary embodiments provide a pixel circuit, a display panel and a display device comprising such a pixel circuit, and a method for controlling the pixel circuit.

The pixel circuit provided by an exemplary embodiment comprises a light emitting element and a driving circuit, the driving circuit comprising a light emission driving circuit for driving the light emitting element to emit light, and a light sensing driving circuit for controlling the light emitting element to convert external light incident on the light emitting element into an electrical signal to realize a light sensing function. The light emitting element used in the pixel circuit according to the embodiment of the present disclosure may be any PN junction-based semiconductor light emitting device including, but not limited to, a light emitting diode, etc. Under the control of the light emission driving circuit and the light sensing driving circuit, the light emitting element can realize the light emitting function and the light sensing function, respectively.

In some exemplary embodiments, the driving circuit comprises a supply voltage input terminal configured to receive a supply voltage, the light emission driving circuit comprises a driving transistor coupled in series between the supply voltage input terminal and the light emitting element, the driving transistor is configured to control connection between the light emitting element and the supply voltage input terminal when the light emitting element performs the light sensing function.

In some exemplary embodiments, the driving circuit comprises a reference potential terminal, the light sensing driving circuit comprises a reset transistor coupled in series between the reference potential terminal and the light emitting element, the reset transistor is configured to control connection between the light emitting element and the reference potential terminal when the light emitting element performs a light emitting function for emitting light.

In some exemplary embodiments, the light sensing driving circuit further comprises a reset control circuit coupled to a gate of the driving transistor, the reset control circuit is configured to control the driving transistor to be turned on before the light emitting element performs the light sensing function.

In some exemplary embodiments, the light sensing driving circuit comprises a source follower coupled to the light emitting element, the source follower is configured to amplify the electrical signal generated by the light emitting element based on the external light.

In some exemplary embodiments, the light sensing driving circuit further comprises a third switching transistor coupled between the source follower and a signal output line.

In some exemplary embodiments, the light emission driving circuit further comprises a fourth transistor coupled between the gate of the driving transistor and a data signal line, and a capacitor coupled between the gate of the driving transistor and the supply voltage input terminal, a gate of the fourth transistor is configured to receive a scan signal.

In some exemplary embodiments, the source follower comprises a fifth transistor, the reset control circuit comprises a sixth transistor, wherein a first terminal and a second terminal of the driving transistor are electrically connected to the supply voltage input terminal and an anode of the light emitting diode respectively, the gate of the driving transistor is electrically connected to a first terminal of the fourth transistor, a first terminal of the capacitor, and a second terminal of the sixth transistor, a second terminal of the fourth transistor is electrically connected to the data signal line, a first terminal of the sixth transistor is configured to receive a constant voltage, a gate of the sixth transistor is configured to receive a reset control signal, a second terminal of the capacitor is electrically connected to the supply voltage input terminal, a cathode of the light emitting diode is electrically connected to a gate of the fifth transistor and a first terminal of a reset transistor, a gate of the reset transistor is configured to receive a reset signal, a second terminal of the reset transistor and a second terminal of the fifth transistor are electrically connected to the reference potential terminal, a first terminal of the fifth transistor is electrically connected to a second terminal of the third transistor, a gate of the third transistor is configured to receive an output control signal, and a first terminal of the third transistor is electrically connected to the signal output line.

In some exemplary embodiments, the supply voltage input terminal is configured to receive a first supply voltage when the light emitting element emits light, and receive a second supply voltage when the light emitting element performs the light sensing function, a polarity of the first supply voltage is opposite to a polarity of the second supply voltage.

Another exemplary embodiment provides a display panel comprising the pixel circuit according to any one of the foregoing embodiments.

In some exemplary embodiments, the light emitting element comprises a micro inorganic light emitting diode, and the display panel comprises an inorganic light emitting diode display panel.

In some exemplary embodiments, the light emitting element comprises an organic light emitting diode, and the display panel comprises an organic light emitting diode display panel.

Another exemplary embodiment proposes a display device comprising the display panel according to any one of the foregoing embodiments.

Yet another exemplary embodiment provides a method for controlling the pixel circuit according to the above embodiments, the method comprising: providing a first supply voltage to the driving circuit when the light emitting element performs a light emitting function to emit light, such that the light emitting element is in a forward-biased state, and providing a second supply voltage to the driving circuit when the light emitting element perform the light sensing function, such that the light emitting element is in a reversely-biased state, wherein a polarity of the second supply voltage is opposite to a polarity of the first supply voltage.

In some exemplary embodiments, the driving circuit comprises a supply voltage input terminal and a reference potential terminal, the light emission driving circuit comprises a driving transistor coupled in series between the supply voltage input terminal and the light emitting element, and a reset transistor coupled in series between the reference potential terminal and the light emitting element, the method comprises controlling the driving transistor and the reset transistor to be turned on prior to the light emitting element begins to perform the light sensing function, thereby resetting the light emitting element.

DETAILED DESCRIPTION OF EMBODIMENTS

Some exemplary embodiments are to be described in detail below by way of examples. It is to be understood that the possible embodiments of the disclosure are not limited to the examples illustrated below, and those skilled in the art can make modifications and variations to the exemplary embodiments herein based on the principle or spirit revealed in the disclosure, thereby obtaining other different embodiments. It is obvious that these embodiments also fall within the scope of the present application.

Figure 1:
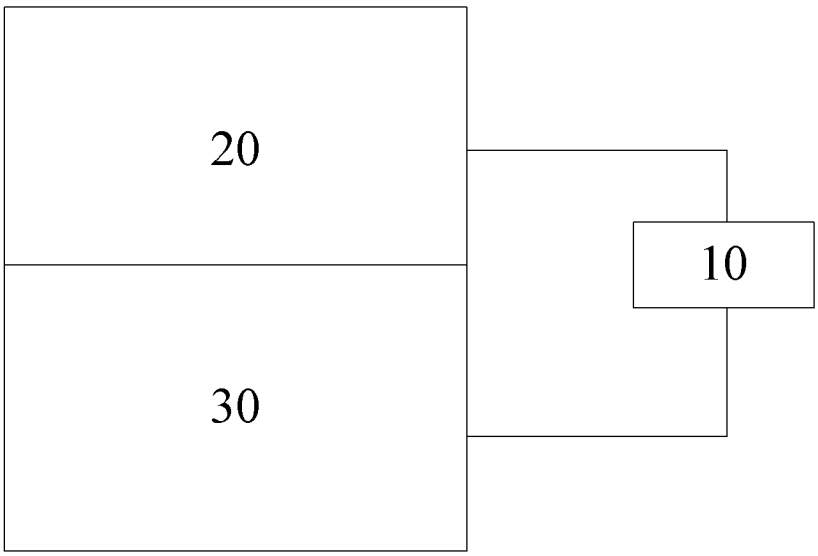
FIG. 1 schematically shows a block diagram of a pixel circuit according to an exemplary embodiment.

An exemplary embodiment provides a pixel circuit comprising a light emitting element and a driving circuit. The driving circuit comprises a light emission driving circuit for driving the light emitting element to emit light, and a light sensing driving circuit for controlling the light emitting element to convert external light incident onto the light emitting element into an electrical signal to achieve a light sensing function. FIG. 1 schematically shows a block diagram of such a pixel circuit. The driving circuit comprises a light emission driving circuit 20 and a light sensing driving circuit 30. A light emitting element 10 can emit light under the control of the light emission driving circuit 20 to display an image. The light sensing driving circuit 30 can control the light emitting element 10 to realize a light sensing function, i.e. converting external light incident onto the light emitting element into an electrical signal. The light emitting element 10 may be a PN junction-based semiconductor device known to those skilled in the art, including but not limited to a light emitting diode and the like.

Inventors of the application have recognized that a semiconductor light emitting device such as a light emitting diode can not only emit light, but also achieve a light sensing function under appropriate control, that is, serving as a photosensitive sensor. For example, for a light emitting diode, it can be in a reversely-biased state by applying a reverse voltage, in this case, the light emitting diode is capable of generating a current signal in response to illumination of external ambient light. That is, for a PN junction-based semiconductor light emitting device, in case it is controlled such that it is in a reversely-biased state, the light emitting device exhibits photosensitivity and can serve as a photosensitive sensor.

Therefore, the driving circuit in the pixel circuit according to the exemplary embodiment can not only drive the light emitting element to emit light, but also enable the light emitting element to act as a light sensing element. It is possible to enable the light emitting element to perform different functions in different time periods. If the pixel circuit is applied to pixel units of a display panel or a display device, it can be considered that each pixel unit is endowed with a light information acquisition function, which may bring great technical improvement to the display device. For example, since each pixel unit in this case has a light sensing function, the light information acquisition function realized by a camera can be replaced by this light sensing function. This makes it possible to not reserve an area dedicated to a camera on the surface of the display device, so that the structural design of the display device can be simplified, and the appearance of the display device can be improved. In addition, in some applications, the display device may further have a fingerprint recognition function, and fingerprint recognition can be realized based on the light sensing function of the light emitting device in the pixel circuit provided by the embodiment of the disclosure. Of course, possible applications of the pixel circuit provided by embodiments are not limited to the above examples, and such a pixel circuit can be applied to any display device that intends to acquire external light information.

The pixel circuit proposed by exemplary embodiments is further illustrated below by way of an example in which the light emitting element 10 is a light emitting diode.

Figure 2:
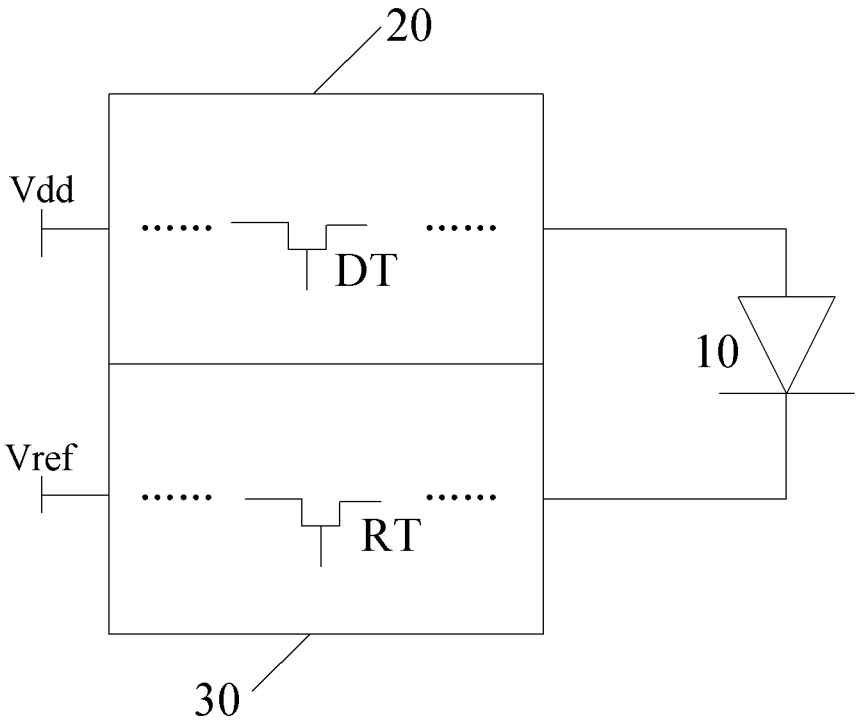
FIG. 2 schematically illustrates shows a light emitting element, a light emission driving circuit, and a light sensing driving circuit in a pixel circuit according to an exemplary embodiment.

As shown in FIG. 2, the driving circuit for the light emitting element 10 comprises a supply voltage input terminal Vdd for receiving a supply voltage and a reference potential terminal Vref. The light emission driving circuit 20 comprises a driving transistor DT coupled in series between the supply voltage input terminal Vdd and the light emitting element 10, and the driving transistor DT serves as a first transistor for controlling connection between the light emitting element 10 and the supply voltage input terminal Vdd during a period when the light emitting element 10 performs the light sensing function. It can be well appreciated that the light emitting function and the light sensing function of the light emitting element 10 are implemented in different time periods. It is possible to provide or stop the operating voltage required for the light emitting element 10 to perform the light emitting function and the light sensing function by controlling turn-on and turn-off for the driving transistor DT.

Further, as shown in FIG. 2, in some exemplary embodiments, the light sensing driving circuit comprises a reset transistor RT coupled in series between the reference potential terminal Vref and the light emitting element 10, and the reset transistor RT serves as a second transistor for controlling connection between the light emitting element 10 and the reference potential terminal Vref during light emission of the light emitting element. The connection between the light emitting element 10 and the reference potential terminal Vref can be achieved by controlling the reset transistor RT. In some exemplary embodiments, the reset transistor RT function as a switching element in the light emission driving circuit 20, for example, as the second transistor for controlling the connection between the light emitting element 10 and the reference potential terminal Vref. Therefore, in such embodiments, the light emission driving circuit 20 and the light sensing driving circuit 30 share some switching devices, which can simplify the circuit configuration of the driving circuit.

Next, an exemplary embodiment of the driving circuit in the pixel circuit will be described in detail by way of a more specific example.

Figure 3:
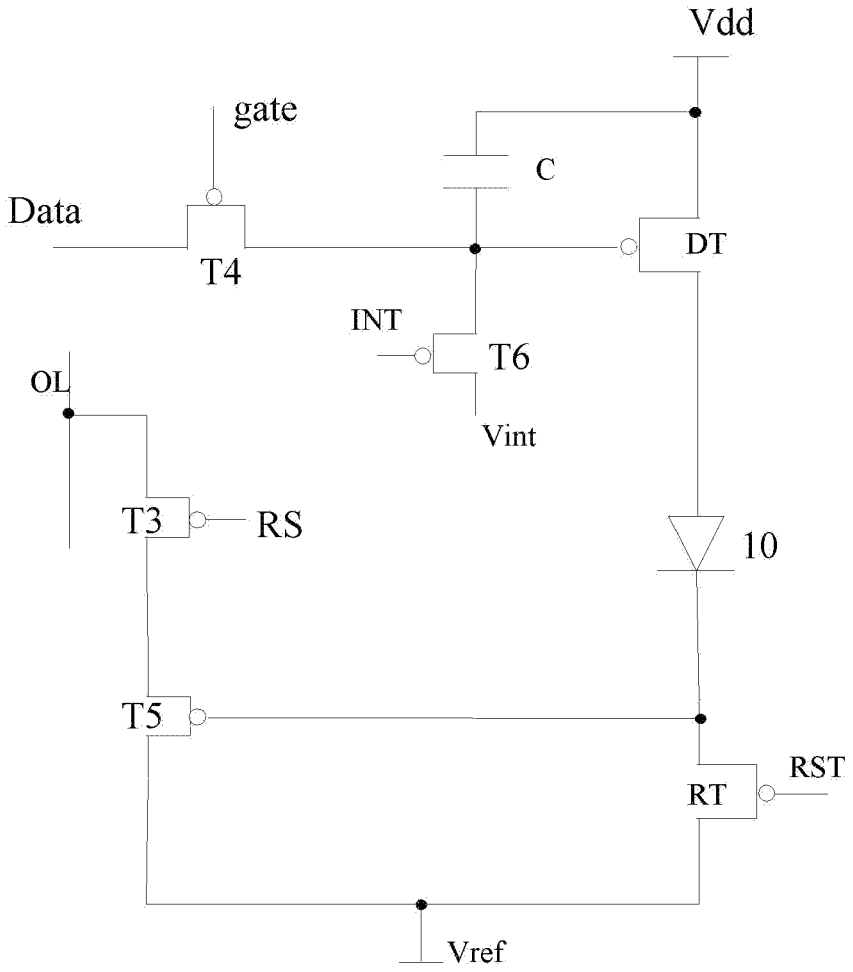
FIG. 3 schematically shows details of a pixel circuit according to an exemplary embodiment.

As shown in FIG. 3, the driving circuit for a light emitting element 10 comprises a driving transistor DT (first transistor), a reset transistor RT (second transistor), a third transistor T3, a fourth transistor T4, a fifth transistor T5, and a sixth transistor T6. In the example of FIG. 3, these transistors are all shown as P-type transistors. Of course, the types of switching elements in the driving circuit are not limited in the present application, and any suitable switching element known to those skilled in the art can be used to implement the driving circuit proposed by the embodiment of the present disclosure.

In the example of FIG. 3, the gate of the fourth transistor T4 may receive a scan signal gate, a first terminal thereof is electrically connected to a data signal line for receiving a data signal Data, and a second terminal thereof is electrically connected to the gate of the driving transistor. A first terminal of the driving transistor DT is electrically connected to the supply voltage input terminal Vdd and a second terminal thereof is electrically connected to the anode of the light emitting element 10 (LED). In addition, a capacitor C is coupled between the first terminal and the gate of the driving transistor DT. The cathode of the light emitting element 10 is electrically connected to the gate of the fifth transistor T5 and a first terminal of the reset transistor RT, respectively. A second terminal of the reset transistor RT is electrically connected to the reference potential terminal Vref, and the gate thereof can receive a reset signal RST. A first terminal of the fifth transistor T5 is electrically connected to the reference potential terminal Vref, and a second terminal of the fifth transistor T5 is electrically connected to a first terminal of the third transistor T3. A second terminal of the third transistor T3 is electrically connected to an output signal line OL, and the gate thereof can receive an output control signal RS. Further, the gate of the sixth transistor T6 in the driving circuit is configured to receive a reset control signal INT, a first terminal thereof is configured to receive a constant voltage Vint, and a second terminal thereof is electrically connected to the gate of the driving transistor DT.

As used herein, a "first terminal" and a "second terminal" associated with the each of the transistors refer to two terminals other than the control terminal (e.g., the gate) of a transistor, such as the source and the drain. Based on the functions of the transistors described in the exemplary embodiments, the transistors can be coupled to each other in different ways according to specific types of the transistors. Therefore, a "first terminal" and a "second terminal" of a transistor are not distinguished herein. In order to understand the functions of the devices in the driving circuit shown in FIG. 3 more clearly, the operation of the driving circuit shown in FIG. 3 will be described below with reference to the exemplary timing diagram shown in FIG. 4.

The operation process of the light emitting element 10 includes a light emitting phase and a light sensing phase. In the light emitting phase, a supply voltage VDD received by the supply voltage input terminal Vdd is positive, so that the light emitting diode 10 is in a forward-biased state. The reset signal RST is at a low level, and the output control signal RS and the reset control signal INT are at a high level. Therefore, the reset transistor RT may be in a turn-on state, and the third transistor T3 and the sixth transistor T6 are in a turn-off state. When the fourth transistor T4 receives an effective level (which is a low level in this example) of the scan signal gate, the fourth transistor T4 is turned on to thereby provide the data signal Data to the gate of the driving transistor DT. The capacitor C is capable of maintaining a voltage difference between the gate of the driving transistor and the first terminal thereof. The data signal Data can adjust the magnitude of the channel current of the driving transistor to thereby drive the light emitting diode 10 to emit light.

Figure 4:
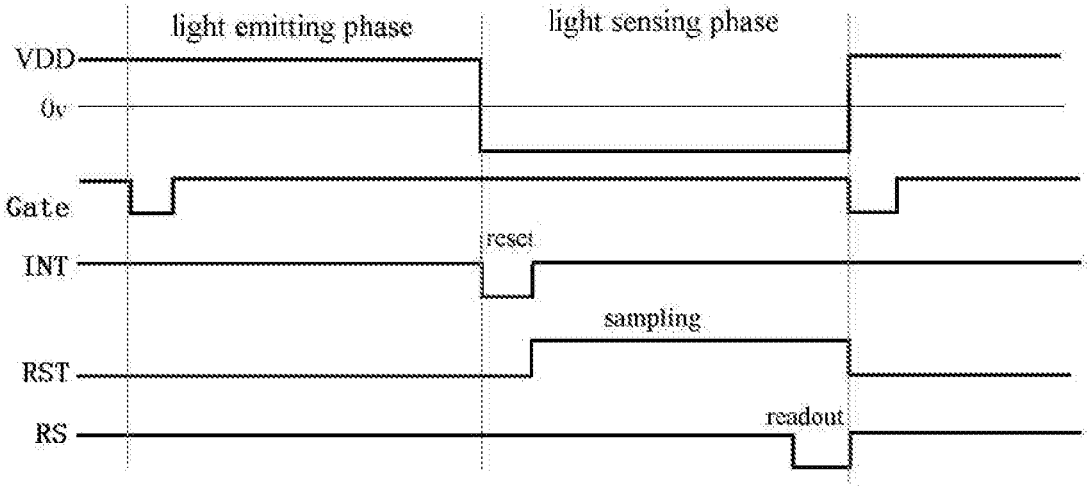
FIG. 4 schematically shows an example of a signal timing diagram for the pixel circuit shown in FIG. 3.

As shown in FIG. 4, the light sensing phase of the light emitting element 10 may include periods such as reset, sampling, readout, etc. In the light sensing phase, the scan signal gate is always at a high level, so that the fourth transistor T4 is always in a turn-off state, and the driving transistor DT would not be affected by the data signal Data. In addition, the supply voltage VDD is a negative voltage, so that the light emitting diode is in a reversely-biased state, which provides a necessary condition for realizing the light sensing function of the light emitting diode. Before the light emitting diode 10 begins to acquire a light signal, two terminals of the light emitting diode may be connected to the supply voltage input terminal and the reference potential terminal respectively to reset the light emitting diode. Therefore, in the initial period of the light sensing phase, the reset control signal INT and the reset signal RST are both at a low level, so that the reset transistor RT and the sixth transistor T6 are in a turn-on state. In this way, the driving transistor DT may be in a turn-on state by receiving a constant voltage Vint at the gate of the driving transistor DT via the sixth transistor T6, so that the anode of the light emitting diode 10 is connected to a negative supply voltage, the cathode thereof is connected to the reference potential terminal, and the light emitting diode is in a reversely-biased state. In the sampling period, the reset signal RST is at a high level, so that the reset transistor RT is turned off. The driving transistor DT may be in a turn-on state due to the voltage maintenance effect of the capacitor C. In case external light is irradiated on the light emitting diode, the light emitting diode can generate carriers at that time, that is, the light emitting diode 10 can generate a current signal in response to irradiation of the external light. The fifth transistor T5 coupled to the light emitting diode may play a role of amplifying current, and the fifth transistor actually constitutes a source follower. Subsequently, in the readout period, the output control signal RS is at a low level, so that the third transistor T3 is turned on. In this way, a current signal resulting from amplification by the source follower can be provided to the output signal line OL via the third transistor T3 for subsequent signal processing.

Therefore, it can be understood from the above exemplary description that the light emission driving circuit and the light sensing driving circuit in the driving circuit shown in FIG. 3 share some devices with each other. Specifically, the driving transistor DT, the reset transistor RT, the fourth transistor T4, and the capacitor are devices of the light emission driving circuit, and the light sensing driving circuit comprises the driving transistor DT, the reset transistor RT, the third transistor T3, the fifth transistor T5, and the sixth transistor T6. Therefore, in the example of FIG. 3, the light emission driving circuit and the light sensing driving circuit share at least the drive transistor DT and the reset transistor RT. In this way, the structure of the driving circuit can be simplified and the cost of the driving circuit can be reduced.

In the example of FIG. 3, the sixth transistor T6 actually constitutes a reset control circuit of the light sensing driving circuit. The reset control circuit is configured to control the driving transistor DT to be turned on before the light emitting element 10 performs the photoelectric conversion function, so that one terminal of the light emitting element 10 is connected to the reference potential terminal and the other is connected to a negative supply voltage. The source follower T5 can amplify the electrical signal generated by the light emitting element based on light conversion, which facilitates subsequent signal processing. Of course, exemplary embodiments of the reset control circuit are not limited to the sixth transistor T6 shown in FIG. 3, and other variant embodiments of the reset control circuit can be obtained by those skilled in the art based on the function of the reset control circuit disclosed herein.

FIG. 3 just schematically shows an example of the pixel circuit. The pixel circuit may be implemented in other forms. For example, the light emission driving circuit and the light sensing driving circuit may share no device, but are totally independent of each other. Moreover, the light emission driving circuit may be refined or modified based on the driving transistor and the light emitting element. For example, the control circuit for the driving transistor DT may be modified to implement a threshold voltage compensation circuit which achieves compensation for the threshold voltage of the driving transistor, so that the impact of the threshold voltage of the driving transistor on the current flowing through the driving transistor is eliminated. The light sensing driving circuit may also not comprise a reset transistor, and other amplification circuits may be used in place of the source follower in FIG. 3. Various variant embodiments of the pixel circuit can be made by those skilled in the art based on the disclosure herein, and these variant embodiments also fall within the scope of the present application.

Since the light emitting element is in a forward-biased state when performing the light emitting function, and needs to be in a reverse-biased state when performing the light sensing function, according to an exemplary embodiment, the supply voltage input terminal receives a first supply voltage during normal image display, and receives a second supply voltage while the light emitting element is performing light sensing, the polarity of the first supply voltage is opposite to that of the second supply voltage. Although the example of FIG. 3 only shows one supply voltage input terminal, the supply voltage input terminal can receive the first supply voltage and the second supply voltage of opposite polarities. However, in other exemplary embodiments, the first supply voltage and the second supply voltage of opposite polarities may be provided from different supply voltage input terminals, respectively.

Furthermore, as mentioned above, the light emitting element in the pixel circuit may be any PN junction-based semiconductor light emitting device, including but not limited to various light emitting diodes, for example, a micro light emitting diode (micro-LED, mini-LED), an organic light emitting diode (OLED), etc.

Another exemplary embodiment provides a display panel which may comprise the pixel circuit described in any of the foregoing embodiments. According to an exemplary embodiment, the light emitting element is a micro inorganic light emitting diode, and the display panel in this case is an inorganic light emitting diode display panel. Alternatively, the light emitting element may be an organic light emitting diode, and the display panel is an organic light emitting diode display panel.

A further exemplary embodiment provides a display device which may comprise the display panel described in the above embodiment. The display device can be any product or component having a display function, including but not limited to a mobile phone, a tablet computer, a television, a display, a notebook computer, a digital photo frame, a navigator, and the like.

Yet another exemplary embodiment provides a method for controlling the pixel circuit described in the foregoing embodiments. The method comprises the following steps: providing a first supply voltage to the driving circuit when the light emitting element performs the light emitting function, such that the light emitting element is in a forward-biased state; providing a second supply voltage to the driving circuit when the light emitting element performs the light sensing function, such that the light emitting element is in a reversely-biased state, the polarity of the second supply voltage is opposite to that of the first supply voltage. That is, with this control method, the light emitting element is configured to perform different functions during different time periods, such that the pixel circuit has both an image display function and a light sensing function.

According to another exemplary embodiment, the driving circuit comprises a supply voltage input terminal and a reference potential terminal, and the light emission driving circuit comprises a driving transistor coupled in series between the supply voltage input terminal and the light emitting element, and a reset transistor coupled in series between the reference potential terminal and the light emitting element. The control method may further comprise controlling the driving transistor and the reset transistor to be turned on before the light emitting element begins to perform photoelectric conversion, thereby resetting the light emitting element.

Exemplary embodiments of the disclosure have been described in detail above. It is to be noted that the above-described embodiments are illustrative and not restrictive, and that those skilled in the art will be able to devise various alternative embodiments without departing from the scope of the appended claims. In the claims, the word "comprise" does not exclude the presence of elements or steps other than those recited in the claims. In addition, the claims do not limit the number of components referred to therein unless specifically defined. The mere fact that certain features are recited in mutually different dependent claims does not indicate that a combination of these features cannot be used to advantage.

The invention claimed is:

1. A pixel circuit comprising a light emitting element and a driving circuit, the driving circuit comprising a light emission driving circuit and a light sensing driving circuit, wherein the light emission driving circuit is configured to drive the light emitting element to emit light, and the light sensing driving circuit is configured to control the light emitting element to convert external light incident onto the light emitting element into an electrical signal to achieve a light sensing function, wherein the driving circuit comprises a supply voltage input terminal configured to receive a supply voltage, the light emission driving circuit comprises a driving transistor coupled in series between the supply voltage input terminal and the light emitting element, wherein the driving transistor is configured to control connection between the light emitting element and the supply voltage input terminal when the light emitting element performs the light sensing function, wherein the supply voltage input terminal is configured to receive a first supply voltage when the light emitting element emits light, and receive a second supply voltage when the light emitting element performs the light sensing function, a polarity of the first supply voltage is opposite to a polarity of the second supply voltage.

2. A method for controlling the pixel circuit according to claim 1, comprising:

providing the first supply voltage to the driving circuit when the light emitting element performs a light emitting function to emit light, such that the light emitting element is in a forward-biased state, and providing the second supply voltage to the driving circuit when the light emitting element perform the light sensing function, such that the light emitting element is in a reversely-biased state, wherein a polarity of the second supply voltage is opposite to a polarity of the first supply voltage.

3. The control method according to claim 2, wherein the driving circuit further comprises a reference potential terminal, the light emission driving circuit further comprises a reset transistor coupled in series between the reference potential terminal and the light emitting element, wherein the method comprises controlling the driving transistor and the reset transistor to be turned on prior to the light emitting element begins to perform the light sensing function, thereby resetting the light emitting element.

4. A display panel comprising the pixel circuit according to claim 1.

5. The display panel according to claim 4, wherein the light emitting element comprises a micro inorganic light emitting diode, and the display panel comprises an inorganic light emitting diode display panel.

6. The display panel according to claim 4, wherein the light emitting element comprises an organic light emitting diode, and the display panel comprises an organic light emitting diode display panel.

7. A display device comprising the display panel according to claim 4.

8. The pixel circuit according to claim 1, wherein the light emitting element comprises a light emitting diode.

9. The pixel circuit according to claim 8, wherein the driving circuit comprises a reference potential terminal, the light sensing driving circuit comprises a reset transistor coupled in series between the reference potential terminal and the light emitting element, wherein the reset transistor is configured to control connection between the light emitting element and the reference potential terminal when the light emitting element performs a light emitting function for emitting light.

10. The pixel circuit according to claim 9, wherein the light sensing driving circuit further comprises a reset control circuit coupled to a gate of the driving transistor, the reset control circuit is configured to control the driving transistor to be turned on before the light emitting element performs the light sensing function.

11. The pixel circuit according to claim 10, wherein the light sensing driving circuit comprises a source follower coupled to the light emitting element, the source follower is configured to amplify the electrical signal generated by the light emitting element based on the external light.

12. The pixel circuit according to claim 11, wherein the light sensing driving circuit further comprises a third switching transistor coupled between the source follower and a signal output line.

13. The pixel circuit according to claim 12, wherein the light emission driving circuit further comprises a fourth transistor coupled between the gate of the driving transistor and a data signal line, and a capacitor coupled between the gate of the driving transistor and the supply voltage input terminal, wherein a gate of the fourth transistor is configured to receive a scan signal.

14. The pixel circuit according to claim 13, wherein the source follower comprises a fifth transistor, the reset control circuit comprises a sixth transistor, wherein a first terminal and a second terminal of the driving transistor are electrically connected to the supply voltage input terminal and an anode of the light emitting diode respectively, the gate of the driving transistor is electrically connected to a first terminal of the fourth transistor, a first terminal of the capacitor, and a second terminal of the sixth transistor, a second terminal of the fourth transistor is electrically connected to the data signal line, a first terminal of the sixth transistor is configured to receive a constant voltage, a gate of the sixth transistor is configured to receive a reset control signal, a second terminal of the capacitor is electrically connected to the supply voltage input terminal, a cathode of the light emitting diode is electrically connected to a gate of the fifth transistor and a first terminal of a reset transistor, a gate of the reset transistor is configured to receive a reset signal, a second terminal of the reset transistor and a second terminal of the fifth transistor are electrically connected to the reference potential terminal, a first terminal of the fifth transistor is electrically connected to a second terminal of the third transistor, a gate of the third transistor is configured to receive an output control signal, and a first terminal of the third transistor is electrically connected to the signal output line.

* * * * *